US012808007B2

(12) United States Patent
Schulze-Kraasch et al.

(10) Patent No.: US 12,808,007 B2
(45) Date of Patent: Nov. 24, 2026

(54) METHOD FOR TEMPER-PASSING A HOT-DIPPED STEEL SHEET AND CORRESPONDINGLY TEMPER-PASSED, HOT-DIPPED STEEL SHEET

(71) Applicant: ThyssenKrupp Steel Europe AG, Duisburg (DE)

(72) Inventors: Folkert Schulze-Kraasch, Duisburg (DE); Fabian Junge, Wesel (DE); Bastian Schöntaube, Willich (DE); Felix Pfützenreuter, Bochum (DE)

(73) Assignee: ThyssenKrupp Steel Europe AG, Duisburg (DE)

( * ) Notice: Subject to any disclaimer, the term of this patent is extended or adjusted under 35 U.S.C. 154(b) by 51 days.

(21) Appl. No.: 18/871,324

(22) PCT Filed: Jun. 5, 2023

(86) PCT No.: PCT/EP2023/064929
§ 371 (c)(1),
(2) Date: Dec. 3, 2024

(87) PCT Pub. No.: WO2023/241966
PCT Pub. Date: Dec. 21, 2023

(65) Prior Publication Data

US 2025/0354229 A1 Nov. 20, 2025

(30) Foreign Application Priority Data

Jun. 14, 2022 (DE) ..... 10 2022 114 928.5

(51) Int. Cl.

| | |
|---|---|
| ***C23C 2/06*** | (2006.01) |
| ***C21D 8/0221*** | (2026.01) |
| ***C21D 9/46*** | (2006.01) |
| ***C22C 18/04*** | (2006.01) |
| ***C23C 2/12*** | (2006.01) |

(52) U.S. Cl.
CPC ..... *C21D 8/0236* (2013.01); *C21D 9/46* (2013.01); *C23C 2/06* (2013.01); *C23C 2/12* (2013.01)

(58) Field of Classification Search
CPC ..... C23C 2/06; C23C 2/26; C22C 18/04
USPC ..... 428/659
See application file for complete search history.

(56) References Cited

U.S. PATENT DOCUMENTS

| | | | |
|---|---|---|---|
| 2011/0165430 | A1 | 7/2011 | Hesse et al. |
| 2015/0209848 | A1 | 7/2015 | Kopplin et al. |
| 2023/0201899 | A1 | 6/2023 | Vogt et al. |

FOREIGN PATENT DOCUMENTS

| | | | |
|---|---|---|---|
| DE | 102019214136 | A1 | 3/2021 |
| DE | 202020100524 | | 5/2021 |
| DE | 102020200321 | A1 | 7/2021 |
| DE | 102020201451 | A1 | 8/2021 |
| DE | 102020208777 | A1 | 1/2022 |
| DE | 102020215248 | A1 | 6/2022 |
| DE | 102021200744 | A1 | 7/2022 |
| EP | 2006037 | A1 | 12/2008 |
| EP | 2892663 | B1 | 7/2015 |
| WO | 2021144192 | A1 | 7/2021 |
| WO | 2021156101 | A1 | 8/2021 |
| WO | 2022013099 | A1 | 1/2022 |
| WO | 2023088783 | A1 | 5/2023 |

OTHER PUBLICATIONS

Thyssenkrupp, DE202020100524U1 Espacenet Apr. 3, 2026 translation, May 4, 2021, entire translation (Year: 2021).*
DIN EN 13523-7:2021.
German Office Action for DE Application No. 10 2022 114 928.5 mailed Apr. 27, 2023.
International Search Report and Written Opinion for International Application No. PCT/EP2023/064929 mailed Jul. 10, 2023.
Robertson, J.; Manning, M.I.: Limits to adherence of oxide scales. Materials Science Technology vol. 6 (1990) 1, S. 81-92.
Vermeulen, Michael; Hobleke, Henrik: Chapter 10: Functionality and characterisation of textured sheet steel products.; Advanced techniques for assessment surface topography: Development of a basis for 3D surface texture standards "Surfstand", S. 249-305.

* cited by examiner

*Primary Examiner* — Katherine A Christy
(74) *Attorney, Agent, or Firm* — RMCK Law Group PLC

(57) ABSTRACT

A skin-pass rolled, hot-dip coated steel sheet that has undergone skin-pass rolling has a steel substrate that is hot-dip coating between two skin-pass rolls in a skin-pass roll mill. One of the skin-pass rolls has a deterministic arrangement of die elements on its surface. Each die element has an area $A_P$ between 12.4 and 32 400 $\mu m^2$ on the surface of the skin-pass roll.

9 Claims, No Drawings

METHOD FOR TEMPER-PASSING A HOT-DIPPED STEEL SHEET AND CORRESPONDINGLY TEMPER-PASSED, HOT-DIPPED STEEL SHEET

CROSS-REFERENCE TO RELATED APPLICATIONS

This application is a 371 U.S. National Stage of International Application No. PCT/EP2023/064929 filed Jun. 5, 2023 which claims the benefit of German Patent Application No. 10 2022 114 928.5 filed Jun. 14, 2022. The disclosures of each of the above applications are incorporated herein by reference in their entirety.

The invention relates to a method of skin-pass rolling a hot dip-coated steel sheet, and to a correspondingly skin pass-rolled, hot dip-coated steel sheet.

Complex forming processes at the interface between substrate and coating lead to elevated material stress, extending as far as delamination of the coating. This is manifested in particular in regions of tight radius in the case of high degrees of forming. One case that should be mentioned here by way of example is sheet metal components for the vehicle industry, the forming of which is characterized by locally high forming stress, for example styling edges or "tornado lines". Delamination of the coating may be associated with various faults, for example reduced component corrosion resistance, unsatisfactory visual appearance on the optionally additionally coated component, surface damage to adjoining sheet regions as a result of delaminated layer parts, which promote elevated abrasion. In the forming process, delaminated layer parts can additionally adversely affect tool lifetime or tool availability, and cause production outages.

It is known from material science that microscale interdigitation can lead to better substrate anchoring of the coating. The mechanism of microscale interdigitation has been described by Robertson for example. This includes a description of an interfacial energy via roughness height and roughness length [Robertson, J.; Manning, M. I.: Limits to adherence of oxide scales. Materials Science and Technology Vol. 6 (1990) 1, p. 81-92].

Also known from sheet metal joining technology is the method of clinching, which describes embossment of the two joining partners at the macroscopic level.

In skin pass rolling operations on hot dip-coated flat steel material according to the prior art, in which the forming elements of the skin-pass roll(s) are generally distributed stochastically/randomly on the skin-pass roll surface, there is no observation of any apparent transference of the forming elements distributed uniformly over the entire surface through the coating and into the substrate layer. Confocal reflected light microscopy, which is known from the prior art, can be used for assessment in order to provide evidence as to the extent to which microscale interdigitation has taken place. For this purpose, samples are created, and these are each surveyed with a surface in the coated and uncoated state after chemical decoating, for example. From the visual appearance of the surfaces, it is already possible to identify through-embossing by the die elements of the skin pass roll in the substrate surface, which can be regarded as an indication of microscale interdigitation. This relationship becomes particularly clear via mathematical correlation evaluations of the topography data of the coated and decoated surfaces. Because of the stochastic/random topography/texture, spatial correspondence of the coated and decoated measurement sites is absolutely necessary. The corresponding correlation images of the coated and decoated surfaces show barely any correlating sheet regions, and so even particularly regularly recurring correlating sheet regions are not apparent. It has been found that only a central maximum is observed as a strongly correlating region, which corresponds to the correlation of the coated and uncoated surface in exactly the same local surface region.

It is therefore an object of the invention to specify not only a method of skin pass rolling a steel sheet but also a skin pass-rolled steel sheet, by which the disadvantages from the prior art can be remedied, especially to ensure adhesion properties of a coating on a steel substrate and to increase the robustness of the forming process.

The object in relation to the method of skin-pass rolling a hot-dip coated steel sheet is achieved by the features of claim 1. The object in relation to the skin-pass rolled, hot-dip coated steel sheet is achieved by the features of claim 5.

A first teaching of the invention relates to a method of skin-pass rolling a hot-dip coated steel sheet, wherein a steel substrate having a hot-dip coating is provided and is conducted between two skin-pass rolls in a skin-pass roll mill, wherein at least one of the skin-pass rolls has a deterministic arrangement of die elements on its surface, wherein each die element has an area $A_P$ between 12.4 and 32 400 $\mu m^2$ on the surface of the skin-pass roll.

The deterministic arrangement of die elements produced on the skin-pass roll, generally by laser ablation, form a "positive" mold which acts on the surface of a coated steel sheet in the course of skin-pass rolling and embosses a surface structure on the coated steel sheet as "negative" mold. Complete embossment/immersion of the die elements is virtually impossible, and so transference of the form of the geometry of the die elements into or onto the surface of the coated steel sheet is greater than 0%, especially greater than 10%, preferably greater than 20% and less than 100%, especially less than 90%, preferably less than 85%.

Methods and apparatuses for production of laser-textured skin-pass rolls are prior art; cf. EP 2 892 663 B1 inter alia. A deterministic surface topography/surface structure or deterministic arrangement of die elements means recurring surface structures having a defined shape and/or configuration; cf. also EP 2 892 663 B1.

By laser, a deterministic arrangement of die elements is introduced into the surface or on the surface of the skin-pass roll by material removal in that a positive influence is possible via controlled actuation of the energy and pulse duration and choice of a suitable wavelength of a laser beam acting on the surface of the skin-pass roll. With a high or higher pulse duration, there is a rise in the interaction time between the laser beam and the surface of the skin-pass roll and it is possible to remove more material on the surface of the skin-pass roll. A pulse leaves an essentially circular crater on the skin-pass roll surface. A reduction in pulse duration influences crater formation; in particular, it is possible to reduce the diameter of the crater. The die elements are thus the remaining raised regions on the surface of the skin-pass roll that have not been affected by the laser. In particular, the bombardment pattern to be generated by means of the laser on the surface of the skin-pass roll may be computer-assisted.

The skin-pass roll is thus provided with a multitude of raised die elements. The number n of die elements in a (partial) reference area $A_{ref}$ gives a number-to-area ratio $Snr=n/A_{ref}$.

It has been found that, surprisingly, when ablation of each die element on the surface of the skin-pass roll results in an area $A_P$ between 12.4 and 32 400 $\mu m^2$, the disadvantages from the prior art can be essentially remedied; in particular, adhesion properties of a coating on a steel substrate can be ensured and the robustness of the forming process can be increased.

A further improvement in coating adhesion in particular on the substrate surface may arise, for example, from the geometry of the die elements on the skin-pass roll when, in one configuration, each die element has an area $A_P$ (n) between 12.4 and 32 400 $\mu m^2$. The area $A_P$ is in particular at least 50 $\mu m^2$, preferably at least 150 $\mu m^2$, more preferably at least 300 $\mu m^2$, further preferably at least 500 $\mu m^2$, and in particular at most 30 000 $\mu m^2$, preferably at most 25 000 $\mu m^2$, more preferably at most 20 000 $\mu m^2$, further preferably at most 15 000 $\mu m^2$.

The areas of the die elements are measured in a section plane $c_p$ in which $d^2Smr(c_o)/dc^2$, the second derivative of the Firestone-Abbott curve Smr(c), has a maximum:

$$d^2Smr(c_0)/dc^2 \cong (Smr(c_0+\Delta c) - 2\,Smr(c_0) + Smr(c_0-\Delta c))/(\Delta c)^2$$

$$d^2Smr(c_P)/dc^2 = \text{maximum}$$

c is the distance of the layer plane, i.e. depth, below a reference plane, for example a height value. For suppression of noise, it may be advantageous to smooth the Smr(c) function by means of an average filter with a width of 1 μm. The discretization margin Δc considered may be less than 0.1 μm.

The average area $A_{P,m}$ of the die elements is apparent from the proportion of material $Smr(c_P)$ divided by the number of die elements per unit area $Snr(c_P)$:

$$A_{P,m} = Smr(c_P)/Snr(c_P).$$

In particular, each die element on the surface of the skin-pass roll may have an area $A_P$ between 500 and 20 000 $\mu m^2$, for example between 750 and 15 000 $\mu m^2$.

Preferably, each die element on the surface of the skin-pass roll may have an area $A_P$ between 1001 and 5000 $\mu m^2$.

In an alternative preferred execution, each die element on the surface of the skin-pass roll may have an area $A_P$ between 5001 and 10 000 $\mu m^2$.

Preferably, each of the two skin-pass rolls is formed with a deterministic arrangement of die elements on its surface, where each die element on the surface of the skin-pass roll has an area $A_P$ between 12.4 and 32 400 $\mu m^2$.

The hot-dip coated flat steel sheet is subjected to skin-pass rolling with the skin-pass roll(s) with a skin-pass reduction of at least 0.1% and at most 2.5%, more preferably with establishment of a skin-pass reduction especially of at least 0.3%, preferably of at least 0.5%. In the case of a skin-pass reduction of more than 2.5%, the mechanical properties would be adversely affected. In order to optimize dimensional accuracy and surface characteristics, the skin pass reduction is especially up to 2.0%, preferably up to 1.7%. The skin-pass rolling operation and the establishment of the skin-pass reduction are prior art.

A second teaching of the invention provides a skin-pass rolled, hot-dip coated steel sheet, where at least one of the surfaces of the skin-pass rolled, hot-dip coated steel sheet has embossments in a deterministic arrangement, wherein a cross-correlation function $r_{z,u}$ is used to compare measured height values $z_i$ on the steel sheet in the hot dip-coated state and measured height values $u_i$ on the steel sheet in the decoated state in the corresponding region, where the correlation coefficient r that results from the cross-correlation function $r_{z,u}$ is at least 0.50.

The correlation coefficient r is found from the cross-correlation function $r_{z,u}$ with $$r_{z,u} = \frac{s_{z,u}}{s_z * s_u}$$

where $s_{z,u}$ is the covariance and is determined by $$s_{z,u} = \frac{1}{n}\sum_{i=1}^{n}(z_i-\bar{z}) * (u_i-\bar{u})$$

with the averages $$\bar{z} = \frac{1}{n}\sum_{i=1}^{n} z_i \text{ and } \bar{u} = \frac{1}{n}\sum_{i=1}^{n} u_i$$

and the standard deviations $$s_z = \sqrt{\frac{1}{n}\sum_{i=1}^{n}(z_i-\bar{z})^2} \text{ and } s_u = \sqrt{\frac{1}{n}\sum_{i=1}^{n}(u_i-\bar{u})^2}.$$

The measurement or evaluation area should be at least 0.5×0.5 $mm^2$. Over and above 1.5×1.5 $mm^2$, shape and corrugations can be eliminated by filter measures. The ascertainment of the correlation coefficient and the underlying formulae are prior art.

By contrast with the prior art, the embossing die elements of the skin-pass roll surface are distributed uniformly both in a planar manner in the plane of the sheet and vertically, especially in the layer structure, and can be discovered/are detectable, for example, with the aid of confocal reflected light microscopy. Coated steel sheets that have been subjected to skin-pass rolling in accordance with the invention have been used to create samples that have each been surveyed with a surface in the coated and uncoated state after chemical decoating in the corresponding region. What is meant by consideration of the coated and the decoated region in a corresponding manner (identical measurement areas) is that a sample examined is considered in a defined measurement area in the coated state and, after decoating, is considered in the identical/the same defined measurement area as before in the coated state. In particular, it is thus possible to indicate an improvement in adhesion properties of the coating on the substrate at the substrate/coating interface and hence to show even form fitting in the interface plane. If the correlation coefficient is high, at least 0.50, it is concluded that there is greater indentation/through-embossment than in the prior art, so as to result in an improvement in adhesion of the coating on/with the substrate.

In particular, the correlation coefficient r is at least 0.550, preferably at least 0.60, more preferably at least 0.650, especially preferably at least 0.70, further preferably at least 0.750, 0.760, 0.770, 0.780, 0.790, 0.80, 0.810, 0.820, 0.830, 0.840, 0.850, 0.860, 0.870, 0.880, 0.890, 0.90, 0.910, 0.920, 0.930, 0.940. A correlation coefficient of 1 would be theoretically possible, but is never likely to occur in practice, and so the correlation coefficient may be up to 1, especially up to 0.990. It is assumed that the adhesion between coating and substrate increases with the correlation coefficient.

The term "steel sheet" generally refers to a flat steel product which may be provided in sheet form (sheet) or else in plate form (plate) or in strip form (steel strip).

The steel sheet has been coated with a hot-dip coating. The skin-pass rolling of a steel sheet having a hot dip coating thus follows the coating operation, in order to specify improved adhesion in the coating/substrate interface by virtue of the die elements embossed in accordance with the invention.

For example, the steel sheet has been hot-dip coated with a zinc-based coating.

In particular, the coating, in addition to zinc and unavoidable impurities, comprises additional elements such as aluminum with a content of at least 0.1% up to 8.0% by weight and/or magnesium with a content of at least 0.1% up to 8.0% by weight. Sheet steels with a zinc-based coat have very good cathodic corrosion protection and have been used in automotive construction for many years. If improved corrosion protection is intended, the coat additionally comprises magnesium in a content of at least 0.3% by weight, in particular of at least 0.6% by weight, preferably of at least 0.9% by weight. Aluminum may be present alternatively or additionally to magnesium with a content of at least 0.3% by weight, especially of at least 0.6% by weight, in order in particular to improve binding of the coat to the sheet steel and in particular to essentially avoid diffusion of iron out of the sheet steel into the coat, in order that good suitability for adhesion, for example, can be assured. Unavoidable impurities and optional further constituents are limited to a total of not more than 2.0% by weight.

A thickness of the coating here may be between 1.5 and 15 μm, in particular between 2 and 12 μm, preferably between 3 and 10 μm.

In an alternative variant, the steel sheet has been hot dip-coated with an aluminum-based coating. A thickness of the coating here may be between 1.5 and 15 μm, in particular between 2 and 12 μm, preferably between 3 and 10 μm.

In particular, the coating comprises, in addition to aluminum and unavoidable impurities, additional elements such as silicon with a content of up to 15% by weight, optionally iron up to 4% by weight, optionally alkali metals or alkaline earth metals up to 1.0% by weight, and optional further constituents having a total content limited to not more than 2.0% by weight.

In a preferred variant, the silicon content is either 0.2% to 4.5% by weight or 7% to 13% by weight, especially 8% to 11% by weight. In a preferred variant, the optional iron content is 0.2% to 4.5% by weight, especially 1% to 4% by weight, preferably 1.5% to 3.5% by weight. In a preferred variant, the optional content of alkali metals or alkaline earth metals is 0.01% to 1.0% by weight of magnesium, especially 0.1% to 0.7% by weight of magnesium, preferably 0.1% to 0.5% by weight of magnesium. In addition, the optional content of alkali metals or alkaline earth metals may especially comprise at least 0.0015% by weight of calcium.

For example, the aluminum-based coating, in an alternative variant, as well as aluminum and unavoidable impurities, comprises additional elements such as zinc 2% to 24% by weight, silicon 1% to 7% by weight, optionally magnesium 1% to 8% by weight when the silicon content should be between 1% and 4% by weight, optionally up to 0.3% by weight in total of Pb, Ni, Zr or Hf.

In a practical test, three coated steel sheets (steel strips) having a zinc-based coating were subjected to skin-pass rolling (EDT1, LT1, LT3). Thickness and composition of the steel strips and thickness and composition of the zinc-based coatings were the same for all three. Three further coated steel sheets (steel strips) having an aluminum-based coating or likewise subjected to skin-pass rolling (EDT2, LT2, LT4). Thickness and composition of the steel strips and thickness and composition of the aluminum-based coating were the same for all three. The skin-pass rolling was conducted on two steel strips with two differently stochastically structured EDT skin-pass roll pairs (EDT1, EDT2) in a skin-pass mill, and on the remaining four steel strips with laser-textured skin-pass roll pairs (LT1, LT2, LT3, LT4) having different deterministic arrangements of die elements in a skin-pass mill. Further parameters are listed in table 1.

TABLE 1

| | EDT1 | EDT2 | LT1 | LT2 | LT3 | LT4 |
|---|---|---|---|---|---|---|
| Smr [%] | 45 | 30 | 31 | 34 | 46 | 40 |
| Snr [1/mm$^2$] | 16 | 288 | 195 | 95 | 52 | 61 |
| $A_{ref}$ [mm$^2$] | 4 | 0.16 | 1.0 | 0.22 | 0.81 | 0.51 |
| n [—] | 62 | 46 | 195 | 21 | 42 | 31 |
| $A_{P,m}$ [μm$^2$] | 29 000 | 1000 | 1589 | 3599 | 8841 | 6570 |

10 samples were taken from each of the six skin-pass rolled coated steel strips, and these were examined in detail. Both the height values of the coated samples and the height values of the chemically decoated samples were measured in different regions by confocal reflected light microscopy in one and the same measurement area of 0.8×0.8 mm$^2$. Decoating was effected as follows: rinsing the samples with ethanol and drying; degalvanizing with inhibited hydrochloric acid (essentially complete removal of the coating); rinsing with ethanol and drying. The measured surface areas of the coated and decoated samples were subjected to a mathematical correlation evaluation of the topography data (μsoft analysis premium 6.2.6967) and the correlation coefficient r was determined. The coated samples were additionally subjected to what is called a T-bend test according to standard EN13523-7, by quantitative detection of the average number of cracks in the cross section. A study according to the Renault method "Multifrottement Test (MFT)" D31_1738, cf. also table 10.1 on page 252 in "Advanced Techniques for Assessment Surface Topography: Development of a Basis for 3D Surface Texture Standards SURFSTAND", ISBN 1 9039 9611 2, was also conducted, such that it was possible to conclude and quantitatively detect possible layer delamination via recording of the friction value over several stress cycles in the MFT test. It was found here that friction owing to possible layer delamination is extremely low when there is marked microscale interdigitation at the coating/substrate interface, where ++ indicates low to zero delamination and – indicates delamination in the MFT at the interface. Table 2 summarizes the results for the samples examined.

TABLE 2

| | EDT1 | EDT2 | LT1 | LT2 | LT3 | LT4 |
|---|---|---|---|---|---|---|
| Correlation coefficient r | max. 0.6 | max. 0.6 | min. 0.85 | min. 0.75 | min. 0.85 | min. 0.75 |
| Number of cracks after T-bend test larger than 500 μm in cross section in the coating | 14 | 11 | 1 | 5 | 8 | 7 |
| Delamination in MFT | – | 0 | ++ | + | + | + |

The invention claimed is:

1. A skin-pass rolled, hot-dip coated steel sheet, that has undergone skin-pass rolling where a steel substrate having a hot-dip coating is provided and is conducted between two skin-pass rolls in a skin-pass roll mill, where at least one of the skin-pass rolls has a deterministic arrangement of die elements on its surface, wherein each die element has an area $A_P$ between 12.4 and 32 400 $\mu m^2$ on the surface of the skin-pass roll, where at least one of the surfaces of the skin-pass rolled, hot-dip coated steel sheet has embossments in a deterministic arrangement, wherein a cross-correlation function $r_{z,u}$ is used to compare measured height values $z_i$ on the outer surface of the steel sheet in the hot dip-coated state and measured height values $u_i$ on the steel sheet in a decoated state after removal of the hot dipped coating in the same measurement region as the hot dip-coated state measurement, where the correlation coefficient r that results from the cross-correlation function $r_{z,u}$ is at least 0.50, wherein r is determined by $r_{z,u}=s_{z,u}/(s_z*s_u)$, wherein $s_{z,u}$ is the covariance of the height values $z_i$ and $u_i$, and $s_z$ and $s_u$ are the respective standard deviations.

2. The steel sheet as claimed in claim 1, wherein the steel sheet has been hot-dip coated with a zinc-based coating.

3. The steel sheet as claimed in claim 2, wherein the coating comprises, in addition to zinc and unavoidable impurities, additional elements including at least one of aluminum with a content of at least 0.1% up to 8.0% by weight and magnesium with a content of at least 0.1% up to 8.0% by weight in the coating.

4. The steel sheet as claimed in claim 1, wherein the steel sheet has been hot-dip coated with an aluminum-based coating.

5. The steel sheet as claimed in claim 4, wherein the coating comprises, in addition to aluminum and unavoidable impurities, additional elements including silicon with a content of up to 15% by weight, iron up to 4% by weight, one of alkali metals and alkaline earth metals up to 1.0% by weight, and further constituents having a total content limited to not more than 2.0% by weight in the coating.

6. The steel sheet as claimed in claim 4, wherein the coating comprises, in addition to aluminum and unavoidable impurities, additional elements including zinc 2% to 24% by weight, silicon 1% to 7% by weight, magnesium 1% to 8% by weight when the silicon content is between 1% and 4% by weight, up to 0.3% by weight in total of Pb, Ni, Zr or Hf, in the coating.

7. A skin-pass rolled, hot-dip coated steel sheet, comprising:

a steel substrate having a surface; and a zinc-based hot-dip coating applied directly to the surface of the steel substrate, the zinc-based hot-dip coating comprising, in addition to zinc and unavoidable impurities, at least one of aluminum with a content of 0.1% to 8.0% by weight and magnesium with a content of 0.1% to 8.0% by weight, and having a thickness of 1.5 μm to 15 μm;

wherein at least one surface of the skin-pass rolled, hot-dip coated steel sheet comprises a plurality of embossments arranged in a deterministic arrangement, the deterministic arrangement comprising recurring surface structures having a defined shape and/or configuration;

wherein a cross-correlation coefficient r, determined by applying a cross-correlation function $r_{z,u}$ to (i) measured height values $_{zi}$ obtained from the at least one surface of the steel sheet in the hot-dip coated state, and (ii) measured height values $u_i$ obtained from the steel sheet in a decoated state in which the zinc-based coating has been chemically removed from the same measurement area used to obtain the height values $z_i$, is at least 0.50, the cross-correlation coefficient r being determined according to:

$$r=s_{z,u}/(s_z*s_u)$$

wherein $s_{z,u}$ is the covariance of the height values $z_i$ and $u_i$, and $s_z$ and $s_u$ are the respective standard deviations of $z_i$ and $u_i$, determined over a measurement area of at least $0.5\times0.5$ $mm^2$;

wherein the cross-correlation coefficient r of at least 0.50 is indicative of through-embossment of the deterministic arrangement of embossments from the zinc-based coating into the steel substrate surface, providing microscale interdigitation at the coating/substrate interface.

8. The steel sheet of claim 7, wherein the correlation coefficient r is at least 0.65.

9. The steel sheet of claim 7, wherein the correlation coefficient r is at least 0.75.

* * * * *